US006842524B1

(12) United States Patent
Kobayashi

(10) Patent No.: US 6,842,524 B1
(45) Date of Patent: Jan. 11, 2005

(54) METHOD FOR LOCALIZING SOUND IMAGE OF REPRODUCING SOUND OF AUDIO SIGNALS FOR STEREOPHONIC REPRODUCTION OUTSIDE SPEAKERS

(75) Inventor: Wataru Kobayashi, Tokyo (JP)

(73) Assignees: OpenHeart Ltd., Tokyo (JP); A Limited Responsibility Company, Research Network, Kyoto (JP)

( * ) Notice: Subject to any disclaimer, the term of this patent is extended or adjusted under 35 U.S.C. 154(b) by 0 days.

(21) Appl. No.: 09/579,460

(22) Filed: May 26, 2000

(51) Int. Cl.[7] ..... H04R 5/00
(52) U.S. Cl. ..... 381/1
(58) Field of Search ..... 381/1, 12, 17–19, 381/309, 310, 97, 119

(56) References Cited

U.S. PATENT DOCUMENTS 4,218,585 A * 8/1980 Carver ..... 179/1
5,657,391 A * 8/1997 Jyosako ..... 381/1

* cited by examiner

*Primary Examiner*—Huyen Le
*Assistant Examiner*—Lun-See Lao
(74) *Attorney, Agent, or Firm*—Duane Morris LLP

(57) ABSTRACT

To provide a method for localizing sound image of reproducing sound outside right and left speakers, by processing and controlling audio signals which allows sound image localization outside the speakers for reproducing the controlled audio signals by means of a very concise hardware architecture. When the audio signals 1L, 1R of right and left channels recorded on fit media for stereophonic reproduction are reproduced, process to emphasize a factor of a sense of direction that listener's hearing has is applied by delaying phase characteristic of the audio signals 1L, 1R without change of frequency characteristics with increase in frequency to drive the speakers 7L , 7R of right and left channels.

15 Claims, 2 Drawing Sheets

METHOD FOR LOCALIZING SOUND IMAGE OF REPRODUCING SOUND OF AUDIO SIGNALS FOR STEREOPHONIC REPRODUCTION OUTSIDE SPEAKERS

BACKGROUND OF THE INVENTION

1. Field of the invention

The present invention relates to a method for localizing sound image of a reproducing sound outside speakers when audio signals recorded on an audio source (recording media) for stereophonic reproduction, such as a CD produced for the purpose of stereophonic reproduction are reproduced by right and left speakers, more particularly to a method for moving the sound image caused by the reproducing sound up and down, and bringing away and near the sound image from the line connected right and left speakers.

2. Description of the Related Art

Conventionally, various technique of localizing sound image in stereophonic listening with right and left speakers for reproduction set have been proposed and tried.

It is said that people generally sense a position of a sound source to be listened, that is to say, the position from the view of a listener about up and down, right and left, front and rear of the sound source by listening with both ears. Therefore, in the stereophonic reproduction, it is thought that the listener can listen to the reproducing sound from the right and left speakers just like sound from a real sound source by applying convolution arithmetic manipulations of real-time to the audio signals, in the sound source, optionally input according to the required transfer function to reproduce the audio signals for localizing the sound source in auditory sense by the reproducing sound from the right and left speakers.

Above-mentioned sound image localization system in stereophonic listening is based on a concept that the sound of the sound source input at random place can be localized in auditory sense by the reproducing sound for stereophonic listening by producing the transfer function to provide outer head sound image localization, in auditory sense, as of the listener listened just like at the place where the real sound source is located, from an expression showing output electrical information of a small microphone to input a pseudo sound source and an expression showing an output signal of an earphone, and by applying the convolution arithmetic manipulations of real-time to optionally input sound signals for reproducing and outputting by means of the transfer function. There is a problem that the system requires a large amount of software for the arithmetic manipulations and a large scale of hardware.

In the invention, considering a problem that the sound image localization technique in the above-mentioned conventional stereophonic listening requires a large amount of software and a large scale of hardware, it is an object to provide a method capable of localizing the sound image of the reproducing sound outside the right and left speakers by processing and controlling the audio signals for stereophonic reproduction which allows the sound image localization outside the right and left speakers using a very concise hardware architecture without such a problem and by reproducing the controlled audio signals.

SUMMARY OF THE INVENTION

The first constitution of the method of the present invention developed to achieve the object is characterized by driving the speakers of right and left channels after application of process to emphasize a factor of a sense of direction that listener's hearing has by delaying a phase characteristic of the audio signals without change of frequency characteristics with increase in frequency at the time of reproducing the audio signals of the right and left channels recorded on fit media for stereophonic reproduction.

In the present invention, a phase characteristic of the audio signals to be delayed without change of frequency characteristics is phase-controlled to draw a curve of n-th degree or polygonal line in which phase delay increases as frequency changes from low range to high range.

The specific constitution of the method of the invention developed to achieve the object is characterized by adding phase difference caused by phase control of the method in addition to sound volume difference or sound volume difference and time difference appended to the audio signals of the right and left channels recorded on the fit media for stereophonic reproduction. Further, the constitution is characterized by dividing frequency band of the audio signals into low-mid range and high range or low range and mid-high range or else low range, mid range and high range to control the phase so that the phase difference increases so as to draw a curve of secondary degree as frequency changes from the low range to the high range, or so that the phase delay is produced so as to draw the polygonal line in the vicinity of the boundary of each bands for driving the speakers of both channels using the controlled audio signals, when the phase difference is added to the audio signals of the right and the left channels.

DESCRIPTION OF THE PREFERRED EMBODIMENTS

Figure 1:
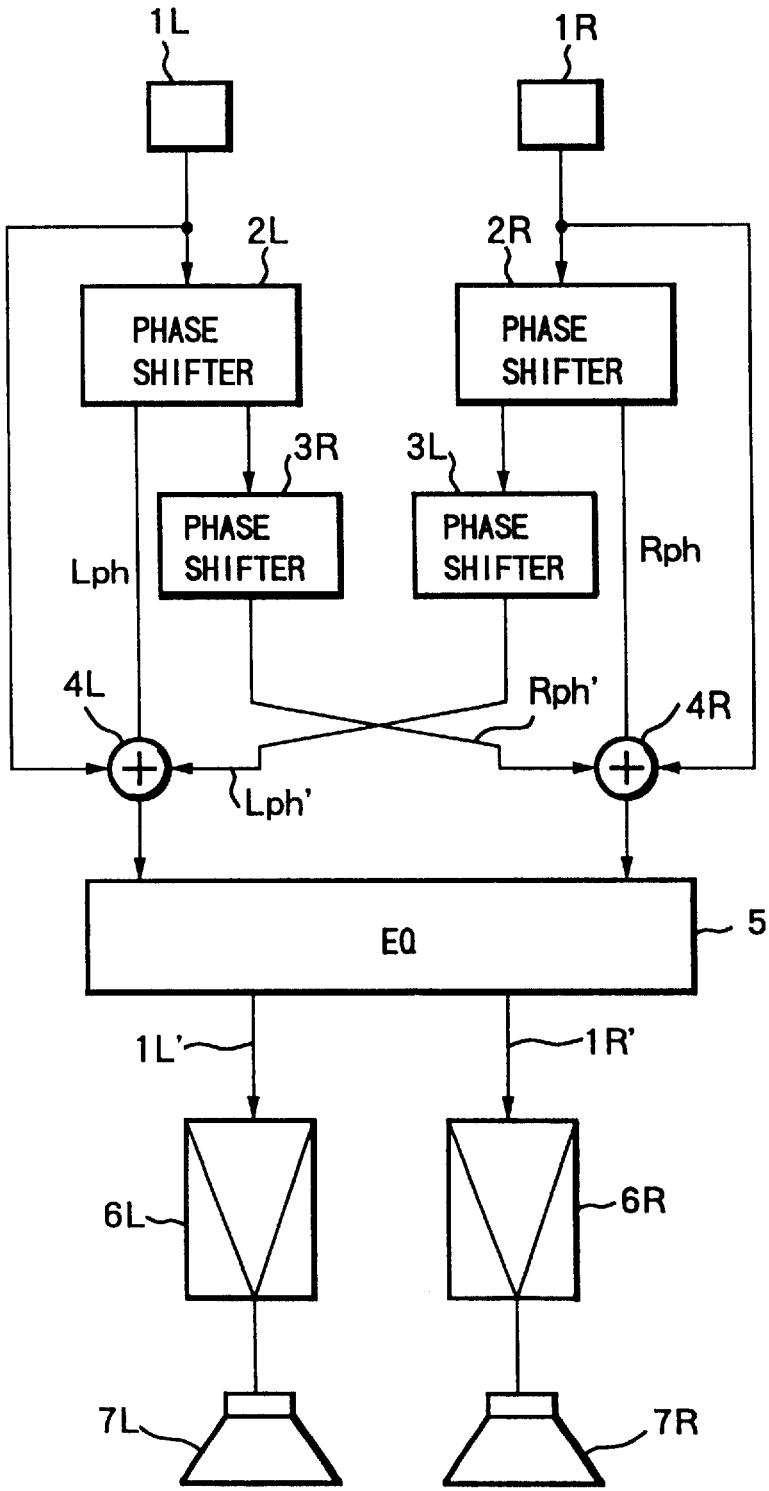
FIG. 1 is a function block diagram showing an example for embodying the present invention.

An embodiment of the method of the present invention will be explained below with reference to the drawings.

In the prior art, various technique for providing sound image localization of the reproducing sound by the speakers in listening with both ears have been provided. A summary of the present invention is that the audio signals are processed so that the sound image localization outside the speakers can be realize with higher-level compared to the prior art without large scale of hardware and software of control system in reproducing the audio signals recorded on the media, such as a CD, for stereophonic reproduction.

In the present invention, the audio signals are divided into three bands of the low range, mid range and high range every channel, as an example, when the audio signals in the both channels recorded on the fit media, such as a CD, for stereophonic reproduction are reproduced. Then, the process for controlling the factor to localize the sound image outside the speakers is applied to every audio signal of each band in both channels. The purpose of this process is that the audio signals for stereophonic reproduction are processed so as to, for example, obtain the auditory sense such that the reproducing sound is transmitted from outside the right and left speakers to the listener's both ears on the assumption that the listener is located in front of real right and left speakers. In the invention, dividing of the audio signals is not limited to the example, it is allowed to divide the band into the mid-low range and the high range or the low range and the mid-high range or the low range and high range, or else into further subdivided bands such as two or four or more bands.

It is thought that sound volume sensed in ears, in the auditory characteristic of human, make the listener sense a sense of distance of the sound image based on the sound volume difference in an attenuation sound or a reflected sound sensed in ears simultaneously by providing the sense of direction of right and left from the sound volume difference sensed in both ears.

It is conventionally known as a so-called stereophonic system to control so as to localize the sound image between the two speakers with balance of the sound volume from two speakers located on right and left in front of the listener in aiming at such the auditory characteristic of human.

But in the conventional stereophonic system, the reproducing sound is only heard from the side of the speaker in which the sound volume has become maximum even if balance control is applied in reproducing so that the sound volume difference become maximum to the both ears. In this case, it is not possible that the stereophonic reproducing sound is heard from outside the speaker, (for example, in case of the left speaker, the reproducing sound is heard from left outside of the left speaker), and the reproducing sound is heard so that the distance between the speakers and the listener is varied.

The present invention is to localize the sound image outside the right and the left speakers using the sound volume difference at the time of reproducing the reproducing sound.

Generally, when people listen the sound of the sound source located at the right side or the left side of the people by people's ears, the sound difference of the sound source between the both ears is smaller than that caused by the sound image localized at the right side and the sound image localized at the left side which are formed by right and left balance control in reproducing the audio signals recorded on stereo.

In stereophonic recording, when the sound image is made localize at the most right side or the most left side in reproducing, the sound from the sound source is recorded so as to be reproduced from a desired right or left speaker. But if the desired sound is reproduced from one of the speakers, the listener does not listen the reproducing sound by only one of both ears. That is to say, the reproducing sound is transmitted to another ear.

The present invention is accomplished by means of a new knowledge that localizing the sound image outside the speakers can be provide by adding the factor in the auditory sense which acts on a sound image position of the reproducing sound except for the sound difference to the audio signals to be recorded with the sound volume difference between the right and left channels in stereophonic recording so as to localize the sound image to the right side or the left side in offset relation at the time of reproducing.

In stereophonic recording, the sound to be localized at the right of the listener in reproducing or the sound to be localized at the left of the listener in reproducing are already mixed at the time of recording, therefore the factor in the time difference at the time that the reproducing sound is transmitted to the both ears of the listener can not be used as the factor for localizing the sound image outside the speakers.

From the view point, the present invention provides a knowledge that application of control to add the phase difference to the audio signals with increase in frequency of the audio signals in addition to the sound difference between the both ears is effective to the sound image localization outside the speakers in reproducing.

The present inventors obtained a knowledge that the phase in the high range has a tendency to delay in comparison with the phase in the low range as the sound source goes away from the ears in the direction of right or left through experiments. This tendency is caused by lengthening of a distance to pass with increase in frequency due to a plane section shape of a head when the reproducing sound is diffracted around the head.

The present invention is to simulatively reproduce the time delay by controlling to add the phase difference to the audio signals to localize the sound image outside the speakers.

An embodiment of the method of the invention will be explained below according to FIG. 1. Reference numerals 1L, 1R indicate the audio signals in the right and left channels recorded for stereo reproduction. The audio signals 1L, 1R are recorded on the fit media such as a CD, a magnetic tape, and a disc, and detected by detecting means, corresponding to the recording system, such as a pickup and a head.

Figure 2:
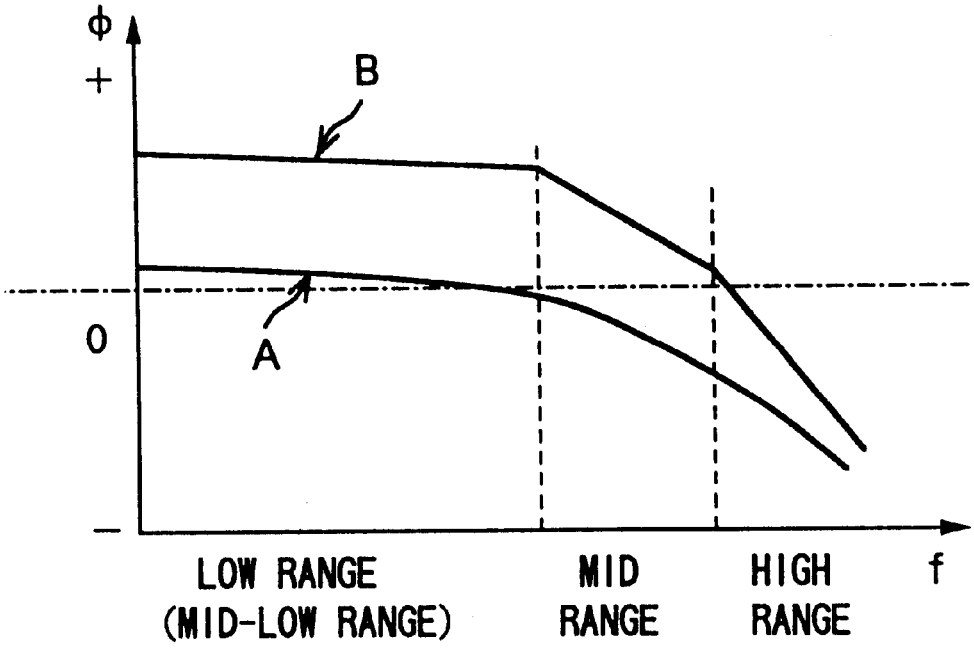
FIG. 2 is a diagram schematically showing an example of a control pattern in the phase control.

Reference numerals 2L, 2R indicate phase shifters to control the phase in the right and left audio signals 1L, 1R corresponding to the frequency band every channel respectively. The phase shifters 2L, 2R phase-control to add the phase difference to the audio signals 1L, 1R to be input therein corresponding to the frequency band as shown schematically in FIG. 2. In FIG. 2, a reference A indicates an example of a control pattern for the phase control so that the phase delay increases with increase in frequency so as to draw the curve of secondary degree, and a reference B indicates an example of a control pattern for the phase control so that the phase delay increases with increase in frequency so as to draw the polygonal line in the vicinity of the boundary of each bands.

Specifically, in low range band not exceeding 1000 Hz, controlling is performed so that no phase delay is produced, or a little phase lead is produced in comparison with the mid range and the high range. In mid range band, controlling for the phase delay is performed so that the phase difference increases with increase in frequency, and in high range band, controlling so that the phase delay increases more with increase in frequency in comparison with the mid range.

Reference numerals 3L, 3R indicate antiphase shifters to apply opposite phase control to only a component of the opposite channel in the audio signals added the phase difference every bands-by the phase shifters 2L, 2R. Reference numerals 4L, 4R indicate mixers of signals in each channel. The audio signals 1L, 1R added nothing, the signals Lph, Rph to be controlled the phase thereof and the signals Lph', Rph', to be applied opposite phase control by the antiphase shifters are provided to the mixer 4L, 4R respectively.

Accordingly, the audio signal 1L to be applied no phase control, the signal Lph to be applied the phase control every band by the phase shifter 2L and the signal Lph' to be applied opposite phase control by the antiphase shifter 3R are mixed in the mixer 4L. On the other hand, the audio signal 1R to be applied no phase control, the signal Rph to be applied the phase control every band by the phase shifter 2R and the signal Rph' to be applied opposite phase control by the antiphase shifter 3L are mixed in the mixer 4R. And the mixed signals in the mixer 4L, 4R are supplied to an equalizer 5.

Signals 1L', 1R' applied the phase control in each of the channels, via the equalizer 5 are amplified by amplifiers 6L, 6R to drive the speakers 7L, 7R to be reproduced from the speakers 7L, 7R.

In the present invention, the sound image of the reproducing sound caused by the audio signals 1L', 1R' applied the phase control so that the phase difference increases with increase in frequency, from the speakers 7L, 7R can be localized outside the located speakers 7L, 7R.

In the present invention, the position of the sound image to be localized outside the speakers can be optionally control, that is to say, the position to localize the sound image can be allowed to optionally change in right and left, up and down, and front and rear outside the speakers by allowing application of the phase control to be independently variable in the phase shifters 2L, 2R, 3L, 3R, respectively. Therefore, in the present invention, the sound image localization can be control in front and rear of the speakers and in up and down of the speakers as well as in right and left outside the speakers by controlling the volume of the both channels to the phase control.

As described herein, the technique for the localization of the sound image according to the conventional stereophonic reproduction is to control and process the reproducing sound using the head transfer function for the outer head sound image localization when the audio signals input from a monaural or a stereo microphone is reproduced for the both ears for stereophonic listening. On the other hand, the present invention is to drive the right and left speakers after application of process to emphasize a factor of a sense of direction that listener's hearing has by delaying phase characteristic of the audio signals without change of frequency characteristics with increase in frequency at the time of reproducing the audio signals recorded on the fit media for stereophonic reproduction. Accordingly, the present invention is allowed to provide superior reproducing sound in the sound image localization and to localize the sound image of the reproducing sound outside the right and left speakers (in front and rear, in up and down, in right and left), and the sound image localization which is not realized in the conventional technique for stereophonic reproduction can be realized. And conventional materials are enough as software for realizing the present invention, that is, as an audio source such as a CD and there is an advantage that a very concise hardware architecture is enough for hardware in control system of the present invention.

What is claimed is:

1. A method for localizing sound image of reproducing sound of audio signals for stereophonic reproduction outside speakers characterized by driving the speakers of right and left channels comprising the steps of dividing a frequency band of an input audio signal of the right and left channels into a low mid range band and a high mid range band, a low range band and a mid range band, or a low range band and a high range band;

phase controlling a phase characteristic of the audio signal of the right and left channels in each band without changing frequency characteristics of the audio signal thereby producing no phase delay or some phase lead with respect to the low range band, and producing a phase delay that increases at the delay side with an increase in frequency with respect to the mid range band and the high range band thereby drawing a curve of secondary degree or drawing a polygonal line in the vicinity of the boundary of each band;

applying opposite phase control to a component of the phase controlled signal; and mixing the input audio signal of the right and left channels, the signal obtained by dividing the input audio signal into frequency bands and phase-controlling according to the band, and a signal in which opposite phase control is applied to a component of a phase controlled signal of the opposite channel at the time of reproducing the audio signals of the channels recorded on fit media for stereophonic reproduction.

2. The method for localizing sound image of reproducing sound of audio signals for stereophonic reproduction outside speakers according to claim 1, in which a factor of a sense of a direction of the reproducing sound to be controlled is to add phase difference caused by phase control to sound volume difference or sound volume difference and time difference appended to the audio signals of the right and left channels recorded on the media for stereophonic reproduction.

3. The method for localizing sound image of reproducing sound of audio signals for stereophonic reproduction outside speakers according to claim 2, in which the sound volume difference and the time difference in the right and left channels of the audio signals recorded on the media, such as a CD, for stereophonic reproduction are used as the factor of the sense of direction of the reproducing sound to be controlled.

4. The method for localizing sound image of reproducing sound of audio signals for stereophonic reproduction outside speakers according to claim 1 in which the mid range band is about 1000–4000 Hz.

5. The method for localizing sound image of reproducing sound of audio signals for stereophonic reproduction outside speakers according to claim 1 in which the low range band is the band of about 1000 Hz or less.

6. The method for localizing sound image of reproducing sound of audio signals for stereophonic reproduction outside speakers according to claim 1 in which the high range band is the band of about 4000 Hz or more.

7. The method for localizing sound image of reproducing sound of audio signals for stereophonic reproduction outside speakers according to claim 2 in which the phase control is to delay to draw the polygonal line in the vicinity of the boundary of frequency band between low-mid range and high range, low range and mid-high range, or low range, mid range and the high range in the audio signals for reproducing.

8. The method for localizing sound image of reproducing sound of audio signals for stereophonic reproduction outside speakers according to claim 7 in which the mid range band is about 1000–4000 Hz.

9. The method for localizing sound image of reproducing sound of audio signals for stereophonic reproduction outside speakers according to claim 7 in which the low range band is the band of about 1000 Hz or less.

10. The method for localizing sound image of reproducing sound of audio signals for stereophonic reproduction outside speakers according to claim 7 in which the high range band is the band of about 4000 Hz or more.

11. The method for localizing sound image of reproducing sound of audio signals for stereophonic reproduction outside speakers according to claim 8 in which the low range band is the band of about 1000 Hz or less.

12. The method for localizing sound image of reproducing sound of audio signals for stereophonic reproduction outside speakers according to claim 8 which the high range band is the band of about 4000 Hz or more.

13. The method for localizing sound image of reproducing sound of audio signals for stereophonic reproduction outside speakers according to claim 9 in which the high range band is the band of about 4000 Hz or more.

14. The method for localizing sound image of reproducing sound of audio signals for stereophonic reproduction outside speakers according to claim 3 in which the phase control is to delay to draw the polygonal line in the vicinity of the boundary of frequency band between low-mid range and high range, low range and mid-high range, or low range, and mid range and the high range in the audio signals for reproducing.

15. The method for localizing sound image of reproducing sound of audio signals for stereophonic reproduction outside speakers according to claim 14 in which the mid range band is about 1000–4000 Hz.

* * * * *